US011708137B2

(12) United States Patent
Moran

(10) Patent No.: US 11,708,137 B2
(45) **Date of Patent: *Jul. 25, 2023**

(54) FLOATING DOCK SYSTEM

(71) Applicant: Michael Patrick Moran, Fort Myers Beach, FL (US)

(72) Inventor: Michael Patrick Moran, Fort Myers Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/894,360

(22) Filed: Aug. 24, 2022

(65) Prior Publication Data

US 2022/0402582 A1 Dec. 22, 2022

Related U.S. Application Data

(63) Continuation of application No. 17/335,768, filed on Jun. 1, 2021, now Pat. No. 11,459,073.

(51) Int. Cl.
*B63C 1/06* (2006.01)

(52) U.S. Cl.
CPC ..... *B63C 1/06* (2013.01)

(58) Field of Classification Search
CPC ..... B63C 1/02–06
See application file for complete search history.

(56) References Cited

U.S. PATENT DOCUMENTS

| | | | | |
|---|---|---|---|---|
| 522 | A | 12/1837 | Thomas | |
| 536,683 | A | 4/1895 | Cousins | |
| 903,215 | A | 11/1908 | Mehlhorn et al. | |
| 3,276,211 | A | 1/1964 | Drake | |
| 3,406,649 | A | 10/1968 | Burkhart | |
| 3,603,276 | A | 9/1971 | Gaston | |
| 3,727,415 | A | 4/1973 | Williams | |
| 3,736,898 | A | 6/1973 | Yamura | |
| 3,991,695 | A | 11/1976 | McDonald | |
| 4,072,119 | A | 2/1978 | Williams | |
| 4,111,144 | A | 9/1978 | Ingvason | |
| 4,955,308 | A | 9/1990 | Craddock | |
| 7,509,916 | B1 | 3/2009 | Nelson, Jr. | |
| 9,957,024 | B2 | 5/2018 | Choi et al. | |
| 11,459,073 | B1 * | 10/2022 | Moran | B63C 1/02 |
| 2019/0135390 | A1 | 5/2019 | Barnes et al. | |

OTHER PUBLICATIONS

Sunstream, Floatlift, Jan. 6, 2007 or earlier, https://sunstreamboatlifts.com/floatlift/.
Hydrohoist, Boat Lifts, Feb. 9, 1999 or earlier, https://www.boatlift.com/boat-lifts/.
Golden Boat Lifts, Floating Dock Lifts, Apr. 21, 2018 or earlier, https://www.goldenboatlifts.com/floating-dock-lifts/.

* cited by examiner

*Primary Examiner* — Janine M Kreck
(74) *Attorney, Agent, or Firm* — George F. Wallace

(57) ABSTRACT

A floating dock system can include a base portion, a cradle, at least one guide assembly, and a lift assembly. The base portion can include a lateral deck portion extending along a first plane and defining a boat slip, and at least one float element configured to provide a float element buoyancy force sufficient to maintain at least part of the deck portion above the water surface. The can include a lateral upper portion extending along a second plane, and a support structure configured to support the nautical vessel. A guide can include male and female guide portions. A lift assembly can include a motor configured to move the cradle between upper and lower positions.

10 Claims, 5 Drawing Sheets

FIG. 6A
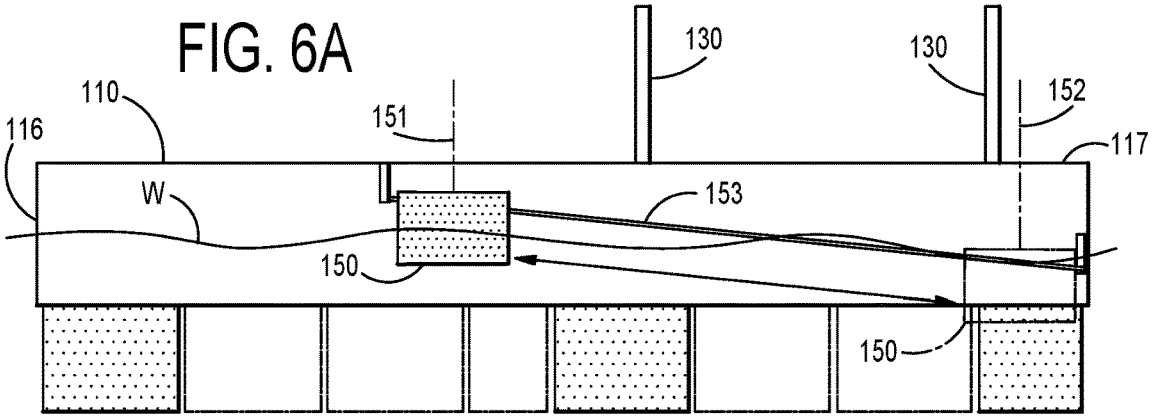
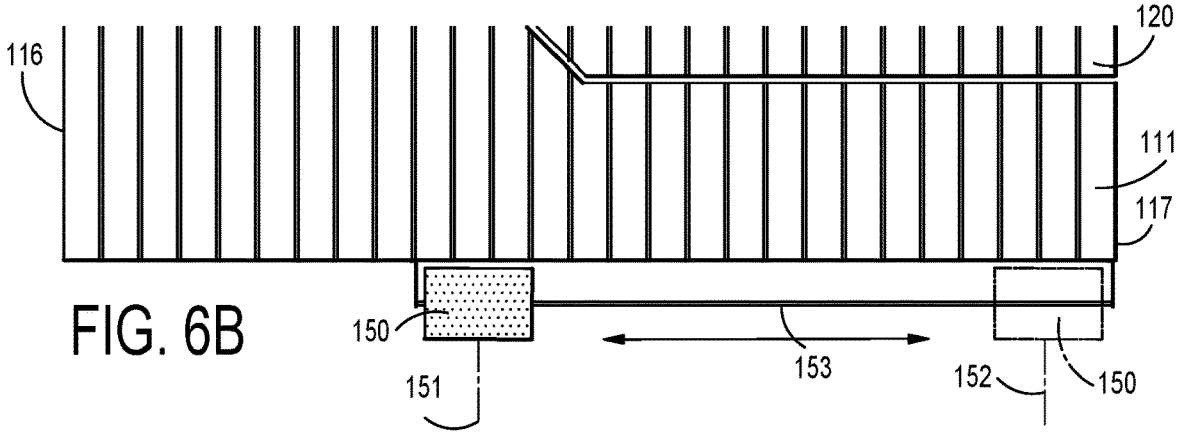
FIG. 6B
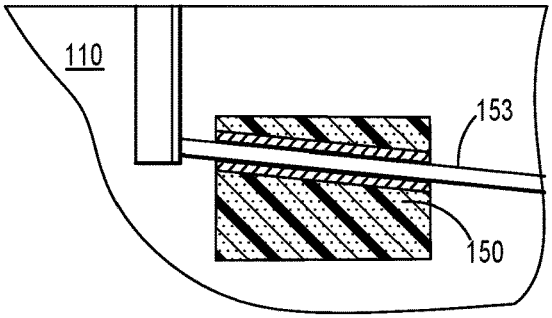
FIG. 6C
FIG. 6D
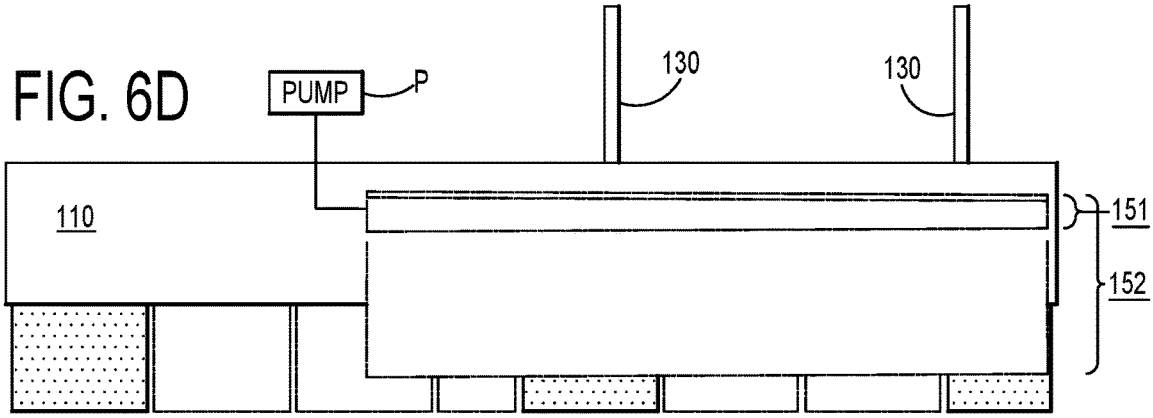

FLOATING DOCK SYSTEM

RELATED DOCUMENTS

This document is related to, claims the priority benefit of, and incorporates by reference in its entirety U.S. patent application Ser. No. 17/335,768 entitled "Floating Dock System" and filed on Jun. 1, 2021.

FIELD OF THE INVENTION

The present invention relates to docks, and more particularly, to floating docks.

BACKGROUND OF THE INVENTION

Docks typically interface between a land mass and a body of water, and allow nautical vessels to attach thereto for temporary storage of such vessels. A dock can be a floating dock.

SUMMARY OF THE INVENTION

The present invention provides a floating dock system.

An exemplary environment of the present invention can include a body of water, which can be naturally occurring or man-made.

According to an exemplary embodiment of the present invention, a floating dock system can include a base portion, a cradle, at least one guide assembly, and a lift assembly.

In an exemplary aspect of the present invention, a base portion can include a lateral deck portion extending at least in part along a first plane and defining a boat slip shaped to accommodate a nautical vessel, and at least one float element connected to the deck portion and configured to provide a float element buoyancy force sufficient to maintain at least part of the deck portion above the water surface.

In another exemplary aspect, a cradle can include a lateral upper portion extending at least in part along a second plane and being complementarily shaped to the boat slip, and a support structure attached to the upper portion and configured to support the nautical vessel.

In a further exemplary aspect, a guide assembly can include a male guide portion connected to one of the base portion and the cradle, and a female guide portion connected to the other of the base portion and the cradle, with the male and female guide portions being moveably engaged with each other.

In still another exemplary aspect, a lift assembly can include a motor and can be operably connected to the base portion and the cradle, and configured to move the cradle relative to the base portion between an upper position, in which the deck portion and the upper portion are coplanar, and a lower position, in which the upper portion is below the deck portion.

In yet another exemplary aspect, as the lift motor moves the cradle from the lower position to the upper position, the guide assembly can guide the cradle to the upper position.

In another exemplary embodiment, when the cradle is in the upper position, the lateral deck portion and the cradle can form a visually continuous lateral structure.

In another exemplary aspect, when the cradle is in the upper position, a distance between the lateral deck portion and the upper portion can be less than 4 inches.

For example and not in limitation, optionally, upper portion 121 can fit "tightly" within boat slip 113, which according to the present invention can mean with less than about four inches of gap between the upper portion and deck portion 111, when first and second planes are coplanar, which can provide a visually continuous plane of material.

In a further exemplary aspect, the base portion can include a plurality of float elements.

In another exemplary aspect, the support structure can be provided as a pair of bunks.

In still another exemplary aspect, the female and male guide portions can be configured to prevent the cradle from contacting the lateral deck portion.

In yet another exemplary aspect, the female and male guide portions can be configured to limit movement of the cradle to upward and downward directions.

According to another exemplary embodiment, a floating dock system can include a plurality of guide assemblies configured to cooperatively guide the cradle to the upper position.

According to another exemplary embodiment, a base portion can further include at least one stabilizer float respectively having a first state providing a first stabilizer buoyancy force when the cradle is in the lower position, and a second stabilizer float state providing a second stabilizer buoyancy force greater than the first buoyancy force when the cradle is in the upper position.

In another exemplary aspect of the present invention, a stabilizer float can change between the first and second states based on movement of the stabilizer float and/or changing the volume of a gas or liquid within a hollow portion of the stabilizer float.

BRIEF DESCRIPTION OF THE DRAWINGS

FIG. 6A illustrates an exemplary stabilizer float subject to motion based state change.

FIG. 6B illustrates another exemplary stabilizer float subject to motion based state change.

FIG. 6C illustrates an exemplary stabilizer float configured to move along a shaft.

FIG. 6D illustrates an exemplary stabilizer float connected to air pump configured to increase and/or decrease a volume of air with the float.

DETAILED DESCRIPTION

Figure 1:
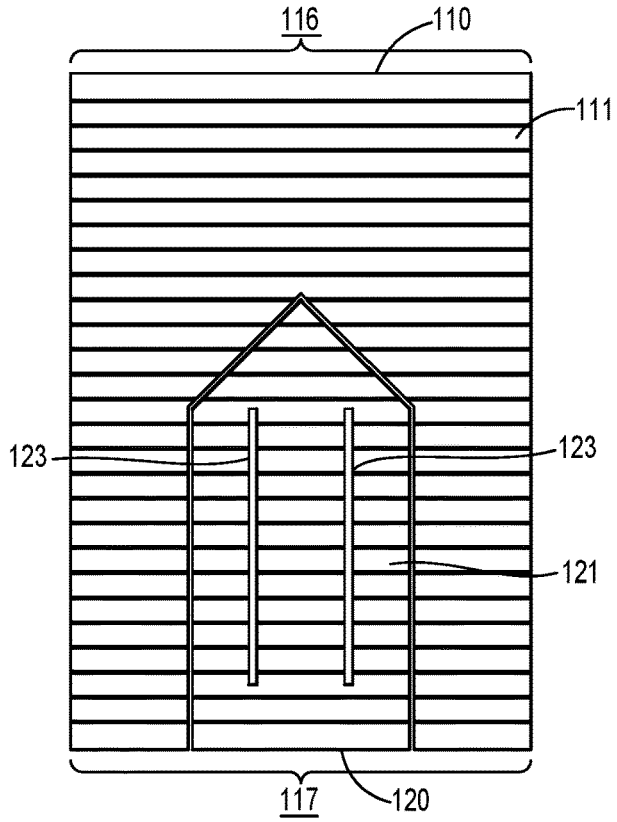
FIG. 1 is a top view of an exemplary base portion including a lateral deck portion and a cradle with a support structure attached thereto.

It is an object of the present invention to provide a floating dock system.

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of the elements and aspects can enable a separate embodiment of the present invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

According to the present invention, a floating dock system can be formed from any one or more materials or combinations of materials, such as one or more of plastic, rubber, wood, metal, a foam, a crystalline material, or any other man-made or naturally occurring material, for example and not in limitation, insofar as functionally consistent with the invention as described. Further, such a system can be manufactured in any one or more functionally compatible manners, such as through molding, cutting, machining, etc. For example and not in limitation, such a system can be formed at least in part from aluminum, a composite of wood fiber and plastic, and plastic. Further, any one or more fastening or attaching structures can be utilized in effectuating the connection or attachment of any two or more components or sub-components of the present invention, such as for example and not in limitation, bolts, nuts, clamps, screws, adhesives, weld seams, etc., insofar as functionally consistent with the invention. Additionally, any one or more structural mechanisms to transfer energy from a motor to any one or more components, independently or in unison, herein may be utilized to effectuate exemplary elements and/or aspects herein. All of which above will be apparent to one of ordinary skill in the art given this disclosure.

Figure 2:
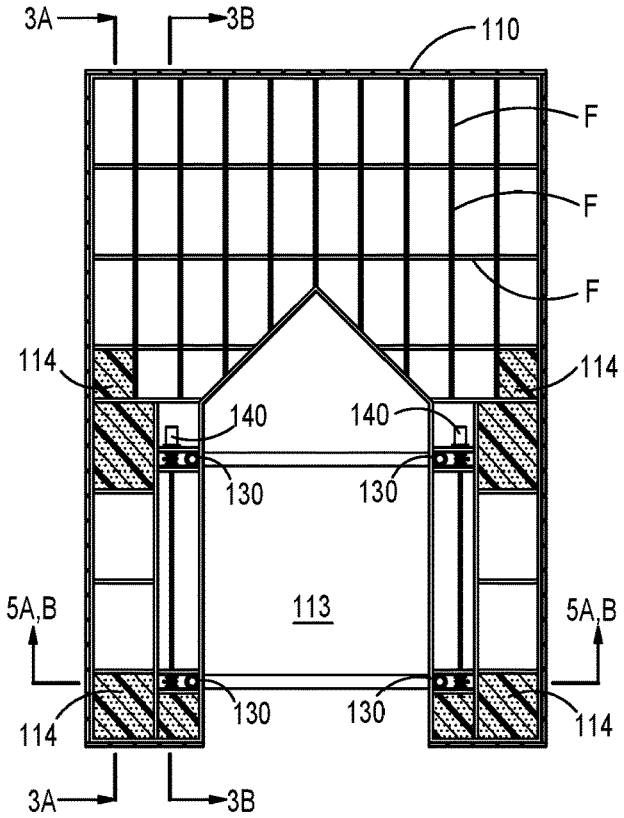
FIG. 2 is a top view of an exemplary base portion having exemplary float elements and lift motors.

FIGS. 1-2 illustrate an exemplary embodiment of the present invention, in which a floating dock system can include a base portion 110, a cradle 120, at least one guide assembly 130, and a lift assembly 140.

Figure 5A:
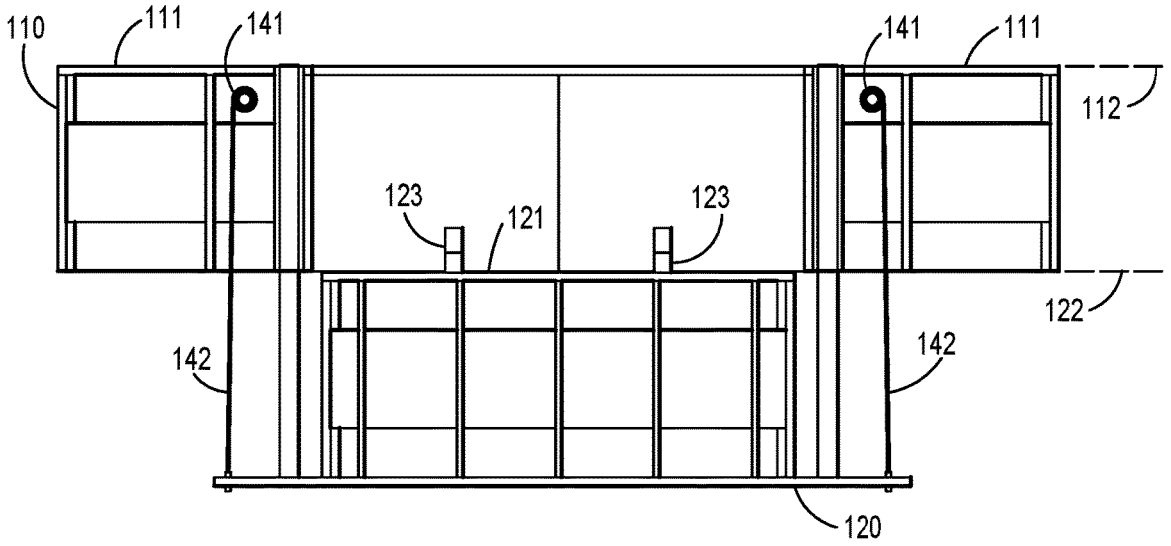
FIG. 5A illustrates an exemplary cradle in a lower position.

In an exemplary aspect, base portion 110 can include a lateral deck portion 111 extending at least in part along a first plane 112 (see FIG. 5A). Deck portion 111 can be provided as one or more structural elements, such as a plurality of slats as illustratively shown in FIG. 1, or can be provided as a unitary structure, such as a continuous material formed of a plastic and wood composite, for example and not in limitation. Further, deck portion 111 can define a boat slip 113 being compatibly shaped to accommodate a nautical vessel (not shown) positioned therein.

In a further exemplary aspect, base portion 110 can further include at least one float element 114 connected to deck portion 111 and configured to provide a float element buoyancy force 115 sufficient to maintain the deck portion at least partially above the water surface. The requisite magnitude of float element buoyancy force 115 will be apparent to one of ordinary skill given the mass of deck portion 111 and structures connected and/or supported thereby. Further, base portion 110 can include a front end 116 and a cradle end 117.

Optionally, to the extent desired, base portion 110 can include framing F positioned under deck portion 111. Notably, insofar as framing F is provided, the same can be provided in any functionally compatible configuration desired, including one or more segments, and can be dictated by the particular configuration of the dock system, the same being within the purview of one of ordinary skill in the art.

In another exemplary aspect, cradle 120 can include a lateral upper portion 121 extending at least in part along a second plane 122 (See FIG. 5A), and a support structure 123 attached to the upper portion. In an exemplary aspect, support structure 123 can engage the hull of a nautical vessel (not shown) thereon and can support the weight of such a vessel as the vessel is lifted upwardly. In an exemplary aspect, support structure 123 can be provided as a plurality of structures, such as a pair of bunks 123 as illustratively shown in FIG. 1, or can be provided as a unitary structure insofar as functionally compatible with the present invention. In a further exemplary aspect, upper portion 121 can be complementarily shaped to boat slip 113. For example and not in limitation, optionally, upper portion 121 can fit "tightly" within boat slip 113, which according to the present invention can mean with less than about four inches of gap between the upper portion and deck portion 111, when first and second planes are coplanar, which can provide a visually continuous plane of material.

In an additional exemplary aspect, as illustratively shown in FIG. 3A-4B, guide assembly 130 can include a male guide portion 131 and a female guide portion 132, with either one being connected to base portion 110 and the other being connected to cradle 120. In an exemplary aspect, male and female guide portions 131, 132 can be moveably engaged with each other, and can provide a defined path of movement of cradle 120 and/or desired spacing between base portion 110 and the cradle when the cradle is in an upper position. According to the present invention, male and female guide portions 131, 132 can be provided with any desired shape and size, insofar as functionally compatible with the present invention.

Figure 3A:
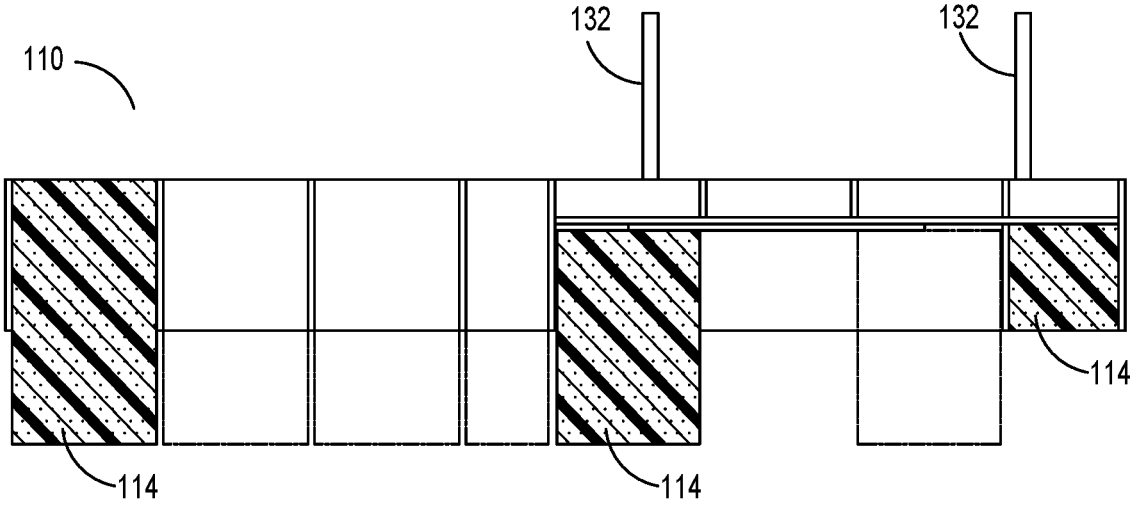
FIG. 3A is section view of an exemplary base portion.
Figure 3B:
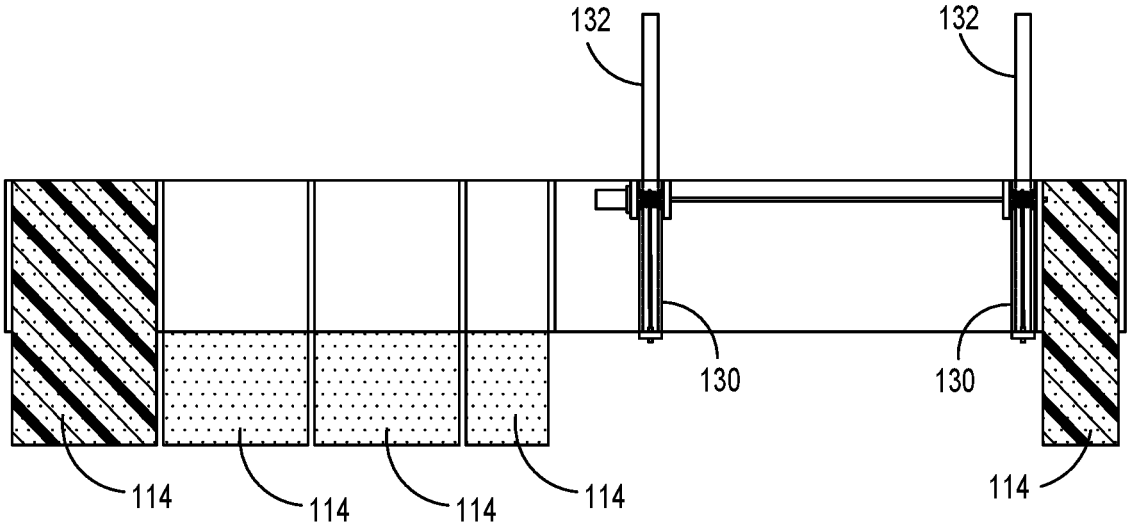
FIG. 3B is another section view of a base portion having exemplary guide assemblies.

FIGS. 3A and 3B illustrate section views of the exemplary base portion 110 illustrated in FIG. 2. As illustratively shown, female guide portion 132 can be fixed to base 110. In one exemplary embodiment, female guide portion 132 can be provided as a hollow cylinder, such as a polyvinyl chloride ("PVC") pipe for example and not in limitation; whilst male guide portion 131 can be provided with a cylindrical shape configured to move through female guide portion 132 as cradle 120 moves between and to lower and upper positions. Notably, the present invention contemplates one or more guide assemblies 132. It should be further noted that male and female portions 131, 132 can be provided with various complementary shapes, which can optionally include respective shapes that can prevent or resist rotation of one portion relative to another. For example and not in limitation, female portion 132 can be provided with a parallelepiped cavity extending therethrough, and male portion 131 can be provided with a complementary parallelepiped shape, such that the male portion can move through the female portion without rotation.

Figure 4A:
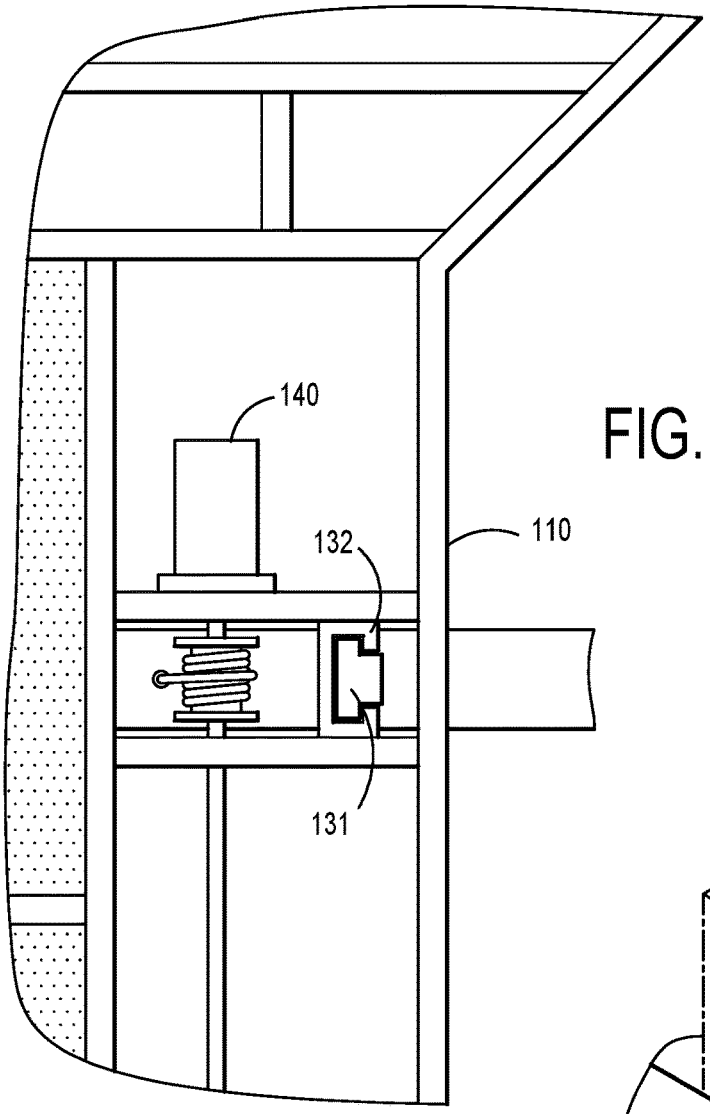
FIG. 4A illustrates an exemplary base portion having a guide assembly with male and female guide portions.
Figure 4B:
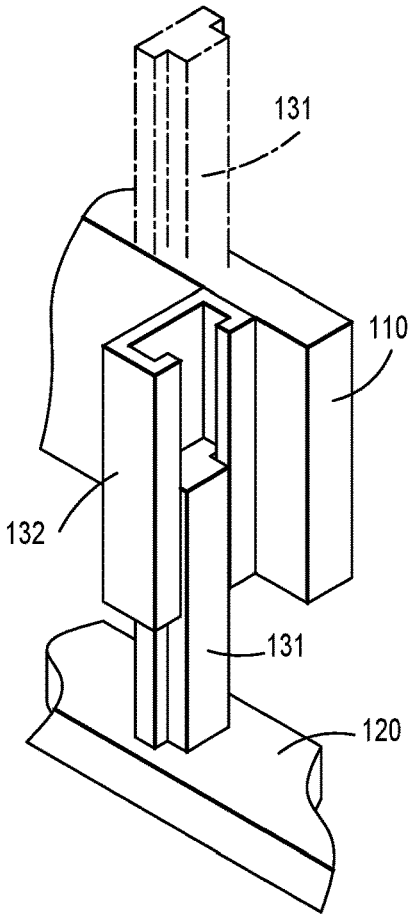
FIG. 4B illustrates an exemplary female guide portion connected to a base portion and exemplary male portion connected to a cradle and engaged with the female guide portion.

FIGS. 4A and 4B illustrate another exemplary embodiment of male and female portions 131, 132. As illustratively shown, male guide portion 131 can be connected to cradle 120 and provided with a T-shape, whilst female guide portion 132 can be connected to base portion 110 can provided with a T-shaped slot. Accordingly, in this particular exemplary embodiment, when moveably engaged, male and female guide portions 131, 132 can be configured to prevent rotation of the male portion (and cradle 120) whilst providing a defined path of movement of cradle 120 and/or spacing between base portion 110 and the cradle when the cradle is in an upper position.

Figure 5B:
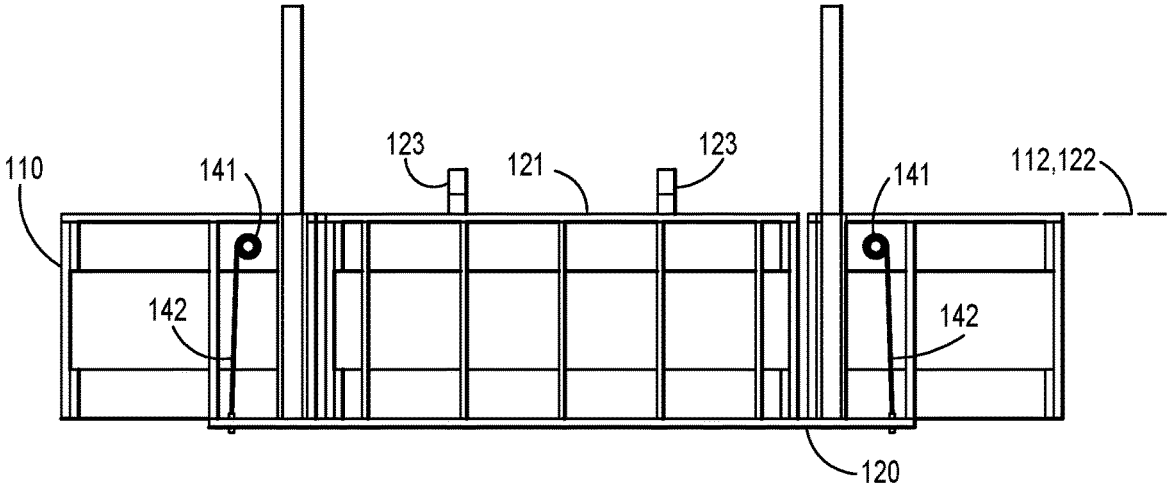
FIG. 5B illustrates an exemplary cradle in an upper position.

As illustrated in FIGS. 2, 5A, and 5B, lift assembly 140 can include at least one motor 141 connected to base portion 110, and at least one lift element 142, such as a cable or screw drive for example and not in limitation, connected to cradle 120 and one or more of the at least one motor. In operation, lift motor 141 can actuate lift element 142 to move cradle 120 between and to a lower position, as illustrated in FIG. 5A, and an upper position, as illustrated in FIG. 5B.

In operation, lift assembly 140 can move cradle 120 to the lower position, in which upper portion 121 is below deck portion 111, so as to lower a nautical vessel positioned on support structure 123 into a body of water or to position the cradle at least partially under a water surface to receive a nautical vessel being docked. Further, lift assembly 140 can move cradle 120 to an upper position, in which deck portion 111 and upper portion 121 are coplanar, with or without a nautical vessel positioned on support structure 123. Where a nautical vessel is positioned on support structure 123 and cradle 120 is in the upper position, such a nautical vessel can be advantageously "dry docked," which can minimize contamination of the body of water from hull paints.

It should be noted that lift assembly 140 is illustratively shown as an electric motor 141 and a cable 142, however, the same can be provided as any known or apparent type of functionally compatible motor and lift element, such as a manual motor and a screw drive, for example and not in limitation.

Optionally, as illustrated in FIGS. 6A-6D, base portion 110 can further include at least one stabilizer float 150 to provide additional buoyancy to accommodate the additional mass of a dry docked nautical vessel and maintain the base portion in an orientation level with body of water W. In an exemplary aspect, a stabilizer float 150 can include a first state 151 where the stabilizer float is at a base location for when cradle 120 is in a lower position and/or when a nautical vessel is not dry docked, and a second state when the stabilizer float is more submerged in body of water W and/or closer to cradle end 117 than when in the base location.

As illustrated in FIGS. 6A and 6B, stabilizer float 150 can change between first and second states 151, 152 based on movement thereof, such as by moving along defined structure, such as a screw shaft 153 (as further illustrated in FIG. 6C), for example and not in limitation, whereby the stabilizer float is further submerged in body of water W when in the second state 152 and less submerged in the body of water W when in the first state 151 (as illustrated in FIG. 6A); and/or the stabilizer float is closer to cradle end 117 when in the second state (as illustrated in FIG. 6B). Notably, movement of stabilizer float 150 can be effectuated via direct or indirect mechanical connection (not shown) to motor 141 or another motor or mechanical movement device insofar as desired.

In another exemplary aspect, alternatively to or conjunctively with a movement-based state change, stabilizer float 150 can change between first and second states 151, 152 based on a change in its volume of a gas or liquid having a specific gravity of less than 1.0. For example and not in limitation, as illustrated in FIG. 6D, stabilizer float 150 can be changed from a first state 151 to a second state 152 by increasing its volume of air via a pump P, which can increase its overall size, so as to move stabilizer float further into body of water W and/or further towards cradle end 117.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore, I claim:

1. A floating dock system for use in a body of water having a water surface, comprising:

a base portion having a front end, a cradle end, a lateral deck portion extending at least in part along a first plane and defining a boat slip compatibly shaped to accommodate a nautical vessel, at least one float element connected to the deck portion and configured to provide a float element buoyancy force sufficient to maintain at least part of the deck portion above the water surface, and at least one stabilizer float;

a cradle having a lateral upper portion extending at least in part along a second plane and being complementarily shaped to the boat slip, and a support structure attached to the upper portion and configured to support the nautical vessel;

at least one guide assembly having one of a female guide portion and a male guide portion connected to said base portion and the other of a female guide portion and a male guide portion connected to said cradle; and a lift assembly having a motor and being operably connected to said base portion and said cradle and configured to move said cradle relative to said base portion between an upper position, in which the deck portion and the upper portion are coplanar, and a lower position, in which the upper portion is below the deck portion;

wherein when said lift assembly moves said cradle from the lower position to the upper position, said at least one guide assembly guides said cradle to the upper position, when said cradle is in the lower position, said at least one stabilizer float is at a particular position between the front and cradle ends, and when said cradle is in the upper position, said at least one stabilizer float is at another position closer to the cradle end.

2. The system of claim 1, wherein when said cradle is in the upper position, the lateral deck portion and said cradle form a visually continuous lateral structure.

3. The system of claim 1, wherein when said cradle is in the upper position, a distance between the lateral deck portion and the upper portion is less than 4 inches.

4. The system of claim 1, wherein said base portion includes a plurality of float elements.

5. The system of claim 1, wherein the support structure is provided as a pair of bunks.

6. The system of claim 1, wherein when said lift motor moves said cradle from the lower position to the upper position, the female and male guide portions are configured to prevent said cradle from contacting the lateral deck portion.

7. The system of claim 1, wherein when said lift motor moves said cradle from the lower position to the upper position, the female and male guide portions are configured to limit movement of said cradle to upward and downward directions.

8. The system of claim 1, wherein the at least one guide assembly is a plurality of guide assemblies that are configured to cooperatively guide said cradle to the upper position.

9. The system of claim 1, wherein said base portion includes a plurality of stabilizer floats.

10. The system of claim 1, wherein one or more of the at least one stabilizer float includes a hollow portion.

* * * * *